US005266069A

United States Patent [19]

Thorne

[11] Patent Number: 5,266,069

[45] Date of Patent: Nov. 30, 1993

[54] FLOTATION BARBELL FOR WATER EXERCISE

[75] Inventor: Lewis C. Thorne, Eugene, Oreg.

[73] Assignee: Excel Sports Science, Inc., Eugene, Oreg.

[21] Appl. No.: 962,919

[22] Filed: Oct. 19, 1992

[51] Int. Cl.[5] ..... A63B 21/008; A63B 21/072

[52] U.S. Cl. ..... 482/111; 482/106; 482/108

[58] Field of Search ..... 482/55, 106, 108, 111, 482/93; 441/55, 56

[56] References Cited

U.S. PATENT DOCUMENTS

| | | | |
|---|---|---|---|
| 4,103,887 | 8/1978 | Shoofler | 482/106 |
| 4,458,896 | 7/1984 | Solloway . | |
| 4,480,829 | 11/1984 | Yacoboski . | |
| 4,623,142 | 11/1986 | MacKechnie . | |
| 4,819,951 | 4/1989 | Solloway . | |
| 4,880,229 | 11/1989 | Broussard | 482/108 |
| 4,902,005 | 2/1990 | McNeill . | |
| 4,988,094 | 1/1991 | Beasley . | |
| 5,033,739 | 7/1991 | MacKechnie . | |
| 5,184,993 | 2/1993 | Dowdeswell | 482/106 |

FOREIGN PATENT DOCUMENTS

| | | | |
|---|---|---|---|
| 2600541 | 12/1987 | France | 482/108 |

*Primary Examiner*—Richard J. Apley

*Assistant Examiner*—Lynne A. Reichard

*Attorney, Agent, or Firm*—John F. Ingman

[57] ABSTRACT

A flotation barbell for water exercise which includes an elongated handle member to which are attached two identical homogenous buoyant triangular end sections, shaped in the form of a triangular prism having two triangular ends and three rectangular sides. The buoyant triangular end sections are attached to the ends of the handle member so that the triangular faces of the end sections are transverse to the longitudinal axis of the elongated handle member, and the corresponding sides of the two end sections are coplanar. The ends of the handle member are inserted into apertures centrally formed between the triangular end faces in each section. An end plate, preferably triangular in shape, includes a central protrusion which extends so as to affixedly engage an end of the handle member, with the end plate pressing against the outer end face of the end section. The end plate additionally includes as at least one, and preferably three, pin-like members extending from proximate the apexes of its triangular shape so as to penetrate and engage the end section. A grip-enhancing cover may be located upon the handle member between the two end sections. A preferred buoyant material for the homogenous triangular end sections is a chemically cross-linked polyethylene having a fine closed-cell structure.

7 Claims, 1 Drawing Sheet

FLOTATION BARBELL FOR WATER EXERCISE

BACKGROUND OF THE INVENTION

1. Field of the Invention

This invention involves a flotation barbell for water exercise, and more particularly, a flotation barbell having buoyant, triangularly shaped end sections which are rotatable within the water to provide variable resistance to exercise movement.

2. Description of the Prior Art

Various aquatic exercising apparatus for the upper body has previously been developed, including barbell-like blade assemblies and perforated ball assemblies (U.S. Pat. No. 4,458,896); circular co-axial disks with variable sector openings fixed on the ends of a handle (U.S. Pat. No. 4,480,829); funnel shaped ends with vanes affixed thereto with flow through a hollow handle (U.S. Pat. No. 4,623,142); complex arrays of axial fins and outer diverging transverse fins (U.S. Pat. No. 4,819,951); apparatus having a flat body section, with variable openings, which extends between the arms of the user (U.S. Pat. No. 4,902,005); barbell-type apparatus suitable for attachment to either hands or feet (U.S. Pat. No. 4,988,094); and barbell-like blade apparatus which has extendable fins and a plugged hollow handle area to provide some flotation capability if desired (U.S. Pat. No. 5,033,739).

In general, the prior art reveals overly complex designs of fins and blades which are often difficult to use. Little concern has been directed to hand grasped apparatus having inherent flotation and providing a simple means of varying resistance to movement in underwater exercise of the muscles of the arm, shoulder, and back, and which also provides support and balance during leg and abdominal exercises.

SUMMARY OF THE INVENTION

The invention involves a flotation barbell for water exercise which includes buoyant end sections in the shape of triangular prisms which, when axially rotated within the water, provide variable resistance to exercise movement.

Accordingly, in the preferred embodiment, the flotation barbell for water exercise includes an elongated handle member to which are attached, on the ends, identical homogenous triangular end sections which are formed of a closed-cell material which is buoyant in water and which are shaped in the form of a triangular prism having two triangular ends and three rectangular sides. The buoyant triangular end sections are attached to the opposing ends of the handle member so that the triangular faces of the end sections are transverse to the longitudinal axis of the elongated handle member, and the corresponding sides of the two end sections are coplanar.

A preferred means of attachment of the buoyant, triangular end sections onto the handle member includes an aperture, formed centrally between the triangular end faces in each buoyant triangular end section, so as to fit over an end of the handle member. An end plate, preferably triangular in shape, includes a central protrusion which extends so as to affixedly engage the end of the handle member with the end plate pressing against the outer end face of the end section. The end plate additionally includes as at least one, and preferably three, pin-like members extending from proximate the apexes of its triangular shape so as to penetrate and engage the end section to provide retention of the end sections in a fixed position, and, in particular, to restrain the end sections from non-aligning rotation about the longitudinal axis of the handle member.

A grip-enhancing cover may be located upon the outside of the handle member between the two buoyant triangular end sections.

A preferred buoyant material for the homogenous triangular end sections is a chemically cross-linked polyethylene having a fine closed-cell structure.

DESCRIPTION OF THE PREFERRED EMBODIMENT

Figure 1:
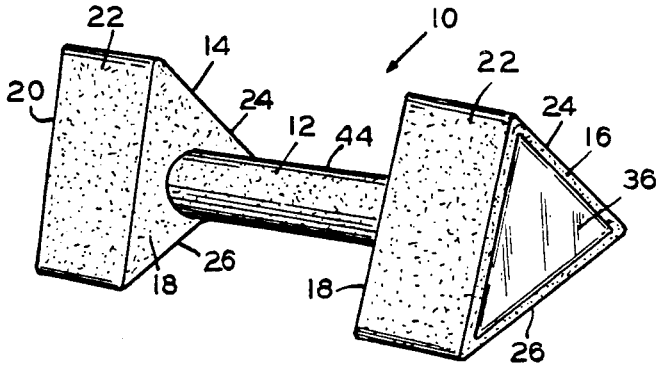
FIG. 1 illustrates a perspective view of the flotation barbell for water exercise.
Figure 3:
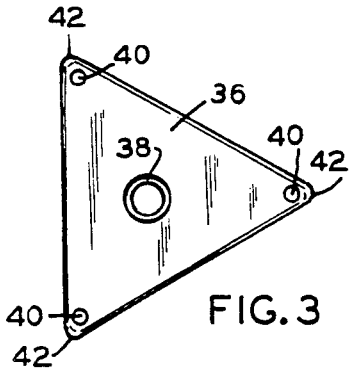
FIG. 3 illustrates a view of an end plate, as seen at line 3—3 of FIG. 2.
Figure 2:
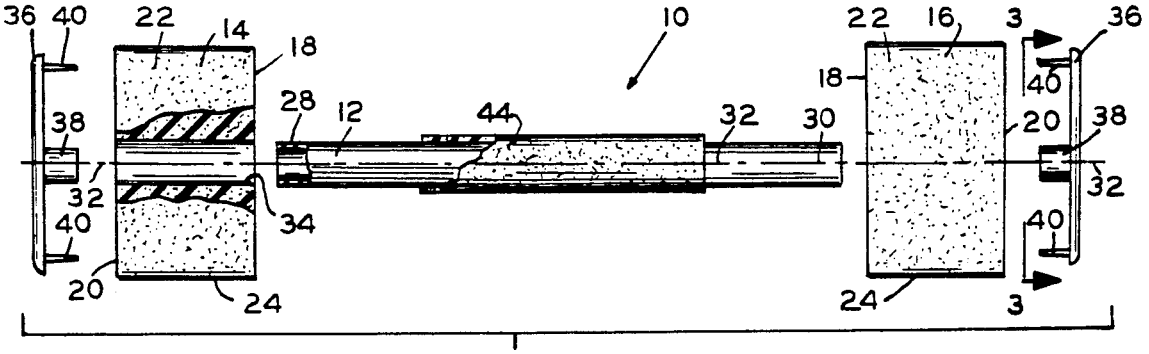
FIG. 2 illustrates an exploded, partially sectioned view of the flotation barbell of FIG. 1.

Turning now to the drawings, there is shown in FIG. I a perspective view, and in FIG. 2 an exploded view, of the preferred embodiment of the flotation barbell for water exercise 10. The flotation barbell 10 includes an elongated tubular handle member 12, such as may be formed with a twelve-inch section of one-inch polyvinylchloride pipe. The end sections 14, 16 are identically formed of a homogeneous buoyant material, with each being shaped in the form of a triangular prism having inner end face 18 and outer end face 20 which are triangular, parallel, and equal in size and shape, and three sides 22, 24, and 26 which are rectangular. The buoyant triangular end sections 14, 16 are attached to the opposing ends 28 and 30, respectively, of the handle member 12, so that the triangular end faces 18, 20 of the end sections 14, 16 are transverse to the longitudinal axis 32 of the handle member 12, and are oriented so that the corresponding sides 22, 24, and 26 of the two end sections 14, 16 are aligned to be coplanar.

A preferred means of attachment of the buoyant, triangular end sections 14, 16 onto the handle member 12 includes an aperture 34 being formed to centrally extend between the inner and outer triangular faces 18 and 20, of each buoyant triangular end section 14, 16 so as to allow an end 28, 30 of the handle member 12 to penetrate therethrough. An end plate 36, preferably triangular in shape, includes a central protrusion 38 which extends so as to affixedly engage the hollow end 28, 30 of the handle member 12, with the end plate 36 pressed tightly against the outer end face 20 of an end section 14, 16. The end plate 36 additionally has at least one, and preferably three, pin-like members 40 extending parallel to protrusion 38, from proximate the apexes 42 of its triangular shape so as to penetrate and engage the end sections 14, 16, thus providing retention of the end sections 14, 16 in a fixed position, and, in particular, restraining the end sections 14, 16 from individual rotation about longitudinal axis 32 of handle member 12.

A tightly fitting, grip-enhancing cover 44 may be located upon the outside of the elongated handle member 12 between the two buoyant triangular end sections 14, 16. This handle cover 44 may also be formed of a buoyant material.

A preferred buoyant material for the homogenous triangular end sections 14, 16, and for the handle cover 44, is a chemically cross-linked polyethylene having a fine closed-cell structure.

In use, the flotation barbell 10 is normally utilized in pairs, one being grasped by the handle member 12 in each hand by the user. A preferred use is in conjunction with the deep water exercise belt (not shown), as described in U.S. Pat. No. 5,000,710, wherein exercise is performed in water of depth greater than the height of the user, with the body of the user being supported in an upright positon by the water exercise belt.

The flotation barbell 10 has two different uses: to provide resistance in the underwater exercise of the muscles of the arm, shoulder, and back; and to provide support and balance during leg and abdominal exercises.

Figure 4:
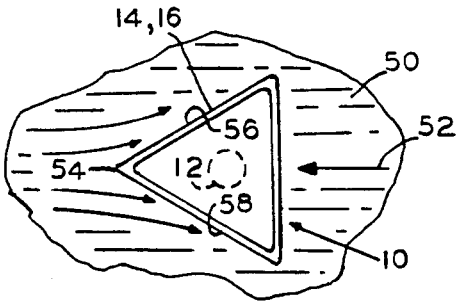
FIG. 4 diagrammatically illustrates an end view of the flotation barbell, moving to the left during water exercise, showing the flow of water past the forward triangular apex of the buoyant end sections.
Figure 5:
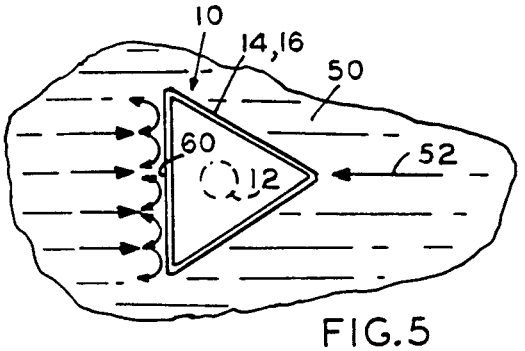
FIG. 5 diagrammatically illustrates an end view of the flotation barbell, having been rotated about the longitudinal axis of the handle member by sixty degrees from the position in FIG. 4 and moving to the left during water exercise, showing the resistance of the water on the perpendicular forward flat surface of the buoyant end sections.
Figure 6:
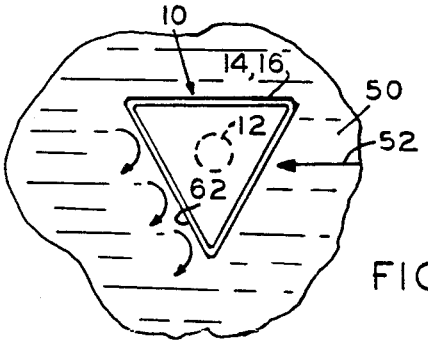
FIG. 6 diagrammatically illustrates an end view of the flotation barbell, having been rotated about the longitudinal axis of the handle member by thirty degrees from the position in FIG. 4 or FIG. 5, and moving to the left during water exercise, providing directional resistance of the water on the angled flat surface of the buoyant end sections.

The design of the flotation barbell 10 permits the user to vary the resistance encountered during movement in water and thus vary the amount of force needed to perform an exercise with the flotation barbell 10. Variance in resistance in exercise movements which are transverse to the longitudinal axis 32 of the handle member 12 is simply obtained by either adjustment of the position of the hand upon the handle member 12, or by simply rotating the wrist, in a manner similar to an oarsman, so that a different orientation of the surfaces 22, 24, 26 engage the water during movement of the flotation barbells 10. FIGS. 4 through 6 illustrate such variance. In FIG. 4, with the flotation barbell 10 being moved to the left in the water 50, as at 52, with an apex 54 of the triangular end sections 14, 16 being pointed forward in the direction of movement 52, minimum resistance in the water 50 is encountered, as the water 50 readily flows past the apex 54 and along the sides 56 and 58. In FIG. 5, the flotation barbell 10 has been rotated sixty degrees, about the longitudinal axis 32 of the handle member 12, so that a surface 60 now is perpendicular to the direction of movement 52, presenting a single flat surface which provides maximum resistance to the movement 52 in water 50 of the flotation barbell 10.

FIG. 6 illustrates another position wherein the longitudinal axis 32 of the handle member 12 has been rotated thirty degrees from the FIG. 4 or FIG. 5 position so as to now present a forward surface 62 at an angle of thirty degrees to the direction of movement 52 in the water 50. Such orientation, as is clear to those skilled in the art, will result in a vertical upward component of resistance being applied to the surface 62, requiring still greater downward muscular effort to be applied by the user to prevent the flotation barbell 10 from rising.

An infinite variety of orientations about the longitudinal axis 32 of the handle member 12 are available, subject to the desire of the user to exercise certain muscles at a certain resistance. Clearly, not all exercises will be conducted with horizontal movement, as diagrammatically illustrated in FIGS. 4 through 6, but any exercise which directs the movement of the flotation barbell 10 transverse to the longitudinal axis 32 of the handle member 12 may have its resistance adjusted with ease. And, of course, the user may grasp the handle member 12 in various manners, to include either a palm-up grip or a palm-down grip, to exercise different muscles.

The inherent buoyancy of the flotation barbell 10 additionally is important in supporting the body during leg and abdominal exercises. For many such exercises, the arms normally would be extended with the barbells near the surface of the water, the balance and support thus gained also being variable, according to the orientation of the surfaces 22, 24, 26 of the end sections 14, 16.

It is thought that the flotation barbell for water exercise of the present invention and its many attendant advantages will be understood from the foregoing description and that it will be apparent that various changes in form, construction and arrangement of the parts thereof may be made without departing from the spirit and scope of the invention or sacrificing all of its material advantages, the form hereinbefore described being merely an exemplary embodiment thereof.

I claim:

1. A flotation barbell for water exercise, comprising:

a. an elongated handle member, having opposing ends and a longitudinal axis;

b. two homogeneous end sections which are buoyant in water, and formed in the shape of a triangular prism having two triangular end faces, an inner triangular end face and an outer triangular end face, and three rectangular sides oriented perpendicular to, and joining said inner triangular end face and said outer triangular end face; and c. means for attaching said end sections upon said opposing ends of said handle member which include:

(1) an aperture formed centrally and extending through each said end section between said inner triangular end face and said outer triangular end face;

(2) said opposing ends of said handle member being inserted within the apertures of said two end sections; and (3) an end plate, having an inner surface adjacent to said outer triangular end face of said end section, which is formed with a central protrusion extending from said inner surface which, when said inner surface of said end plate is installed against said outer triangular end face of said end section, engages said end of said handle member; said end plate also having at least one pin-like member, spaced from said central protrusion and extending from said inner surface, which pierces and engages said outer triangular end face of said end section so as to restrain said end sections from rotation about said longitudinal axis of said handle member;

d. said end sections being attached at said ends of said handle member so that said inner and outer triangular end faces of each end section are substantially perpendicular to said longitudinal axis of said handle member, and said rectangular sides of one end section are aligned to be substantially coplanar with corresponding rectangular sides of the second end section.

2. The flotation barbell for water exercise, as recited in claim 1, wherein said end plate is triangular in shape.

3. The flotation barbell for water exercise, as recited in claim 2, where there are three pin-like members, each extending from said inner surface of said triangular end plate at a location proximate an apex of said triangular end plate.

4. The flotation barbell for water exercise, as recited in claim 1, where said homogeneous triangular end sections are formed of chemically cross-linked polyethylene having a fine closed-cell structure.

5. The flotation barbell for water exercise, as recited in claim 1, where, additionally, a cover encloses the handle member between the inner faces of said two buoyant triangular end sections.

6. The flotation barbell for water exercise, as recited in claim 5, where said cover is formed of chemically cross-linked polyethylene having a fine closed-cell structure.

7. A flotation barbell for water exercise, comprising:

a. an elongated handle member, having opposite ends;

b. two homogeneous end sections which are buoyant in water, and formed having two opposing end faces, an inner end face and an outer end face; and c. means for attaching said end sections upon said opposing ends of said handle member which include:

(1) an aperture formed centrally and extending through each said end section between said inner end face and said outer end face;

(2) said opposing ends of said handle member being inserted within said apertures of said two end sections; and (3) an end plate, having an inner surface adjacent to said outer end face of said end section, which is formed with a central protrusion extending from said inner surface which, when said inner surface of said end plate is installed against said outer end face of said end section, engages said end of said handle member; said end plate also having at least one pin-like member, spaced from said central protrusion and extending from said inner surface, which pierces and engages said outer end face of said end section.

* * * * *